United States Patent [19]

Orzechowski et al.

[11] 3,952,970

[45] Apr. 27, 1976

[54] MEANS FOR IMPROVING ROCKET MISSILE ACCURACY

[75] Inventors: Casimir T. Orzechowski, Kensington; Nat Seiden, Brandywine, both of Md.

[73] Assignee: The United States of America as represented by the Secretary of the Navy, Washington, D.C.

[22] Filed: Aug. 28, 1974

[21] Appl. No.: 501,307

[52] U.S. Cl. ..... 244/3.23; 244/3.29

[51] Int. Cl.[2] ..... F42B 13/32

[58] Field of Search ..... 244/3.23, 3.27, 3.28, 244/3.29

[56] References Cited

UNITED STATES PATENTS

| | | | |
|---|---|---|---|
| 2,858,765 | 11/1958 | Startzell | 244/3.29 |
| 2,924,175 | 2/1960 | Jasse | 244/3.29 |
| 3,790,103 | 2/1974 | Peoples | 244/3.23 |

FOREIGN PATENTS OR APPLICATIONS

| | | | |
|---|---|---|---|
| 1,418,696 | 12/1964 | France | 244/3.28 |

*Primary Examiner*—Verlin R. Pendegrass
*Attorney, Agent, or Firm*—R. Sciascia; R. Beers; S. Scheinbein

[57] ABSTRACT

This invention comprises wrap-around fins for a rocket missile, the fins being mounted on rods which are borne by a spool-like runner which encircles the nozzle body of a rocket missile. The nozzle body is exteriorly coated with teflon. The spool-like member has a ring-shaped extension on each end, each of which fits into a ring-shaped teflon bearing which, in turn, fits into a slot in a flange on the nozzle body whereby the spool-like member and the fins which are mounted on it are free to rotate relative to the nozzle (and therefore the rocket) body. The interior of the nozzle of the rocket is formed with flutes, the action of the exiting gases on the flutes causing the missile body to rotate in flight.

13 Claims, 2 Drawing Figures

MEANS FOR IMPROVING ROCKET MISSILE ACCURACY

BACKGROUND OF THE INVENTION

This invention relates to rocket missiles and especially to means for improving the ballistic accuracy of tube-launched rockets through freely rotating, bearing-mounted, wrap-around fins.

The military departments of all nations are turning more and more to missiles such as rockets for ground-to-ground, air-to-air and air-to-ground weaponry. To stabilize the flight of such rockets, fins are employed, usually at the nozzle end of a rocket.

Rockets which are not spin-stabilized because they are given no spin at the start of their flight are inaccurate i.e., they have large dispersions. Even rockets with fins which provide spin stabilization usually have too much dispersion to satisfy the military because wind pressure against the fins produces yaw and pitch of the rocket. Thus there is a continuing need and motivation for improving the ballistic characteristics and accuracy of rocket missiles.

SUMMARY OF THE INVENTION

The present invention accomplishes its objects by providing wrap-around fins which are decoupled from the spin of the rocket, i.e., the wrap-around fins and the rocket body are free to rotate relative to each other. The decoupling of the motion of the rocket from the pushing forces on the fins greatly improves the ballistic accuracy of the rocket.

An object of the invention is to permit wrap-around fins mounted on a rocket body to rotate freely relative to the body itself.

Another object is to decouple the motion of the rocket from pushing forces exerted on the fins.

Yet another object is to improve the spin stability of a rocket missile.

Other objects, advantages, and novel features of the present invention will become apparent from the following detailed description of the invention when considered in conjunction with the accompanying drawings.

DETAILED DESCRITPION OF THE INVENTION

Figure 1:
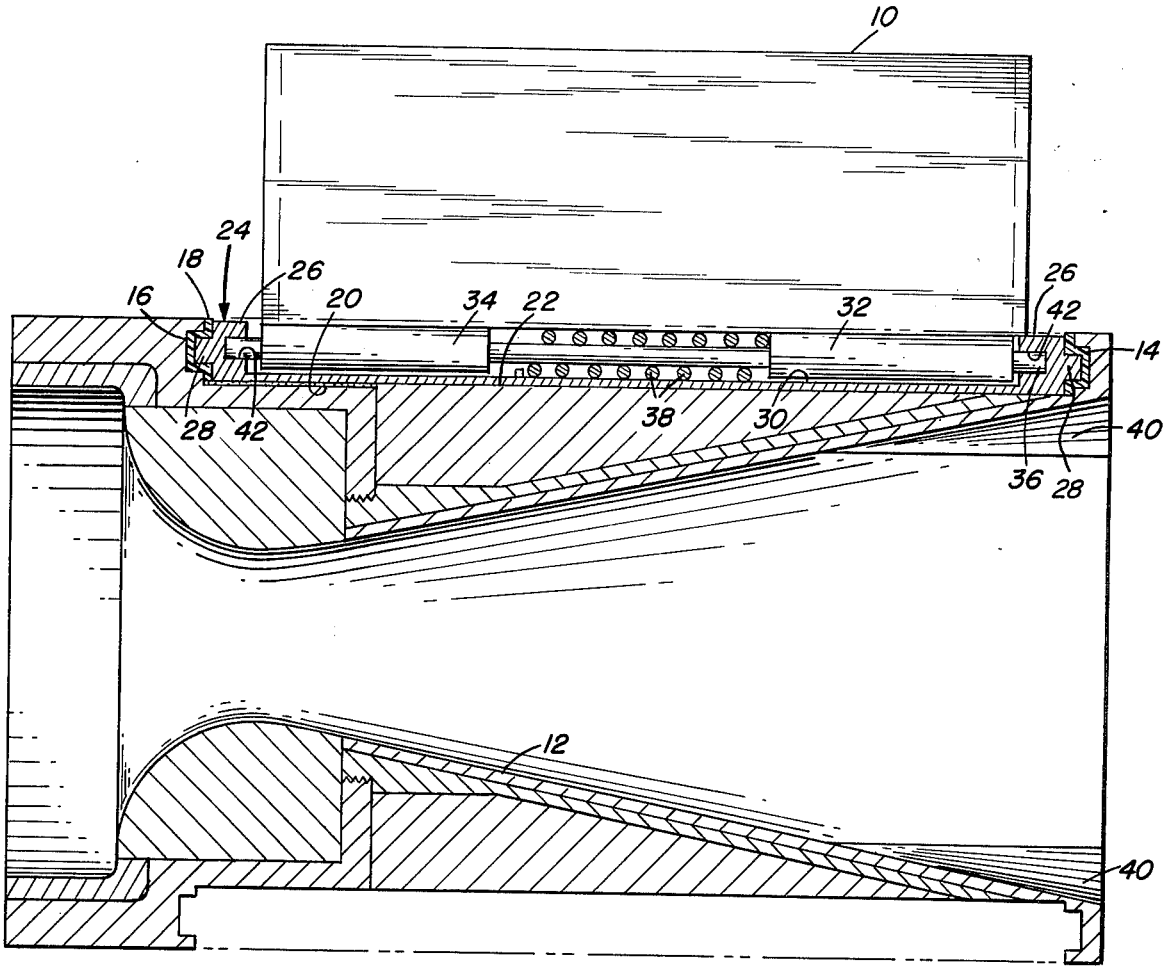
FIG. 1 is a partial view of a rocket missile showing an embodiment of the invention containing a representative fin and the nozzle body in longitudinal cross-section.

FIG. 1 is an embodiment which illustrates the invention. The figure shows a fin 10 mounted on the nozzle 12 of a rocket missile (not shown). There are four identical fins (although only one is shown) spaced equidistantly around the outside of the nozzle 12.

The nozzle body has a pair of ring-shaped slots 14 and 16 into each of which a ring-shaped insert, or bearing, 18 fits securely. A coating 20 is placed around the narrow part 22 of the nozzle body 12.

A spool-shaped cylindrical member 24 having a central tubular section 30 with a flange 26 at each end has a circular rearward-projecting ring 28 which fits into the slot 16 in the bearing 18. The central section 30 has a hollow center 44 which surrounds the narrow part 22 of the nozzle body. This rearward projecting ring 28 on the spool-shaped member 24 will hereinafter be called a "neck" or "neck ring" and the spool-shaped member 24 will hereinafter be called the "runner" because it is movable by sliding around the narrow part 22 of the nozzle body, i.e., the central tubular section 30 of the runner 24 fits around and rotates around the narrow part 22 of the nozzle body. To accomplish this, the bearing 18 and the coating 20 are made of a low-friction material such as teflon.

Figure 2:
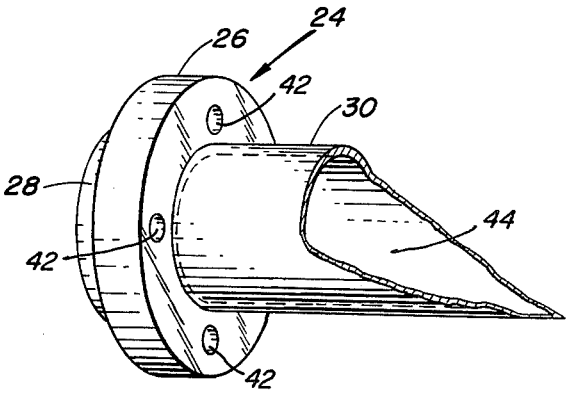
FIG. 2 is a partial perspective view of the runner utilized in this invention showing the rear end and rear portion of the central tubular section.

FIG. 2, in which the rear portion of the runner 24 is illustrated, shows the flange 26 and the rearward projecting ring 28 on the rear section of the runner 24. Note that section 30, if shown in full, would extend to the right and would have another flange 26 and ring 28 on the right side.

Each wrap-around fin 10 is roughly rectangular in shape (see FIG. 3) and is secured to a pair of tubular mounting members 32 and 34 which lie at the bottom of the fin. A fin-mounting rod 36 fits through the tube members 32 and 34 and rotatably supports the fin 10. A biasing means 38, which may be a coil spring, is placed around the rod 36 between the tube members 32 and 34 for erecting the fin. The rod 36 fits into holes 42 in the front and aft flanges 26 of the runner.

When the rocket is fired, the hot gases exiting through the nozzle propel the rocket out of a rocket launcher tube. While in this tube, the fins are folded or wrapped around the nozzle body. When the fins are clear of the launcher tube, the spring 38 erects the fins and propels them rearwards into four slots (not shown) in the aft flange of the runner 24 so that the fins are locked with the runner.

The inside of the nozzle has flutes 40 at its end so that the gases rotate the missile body as they exit. The fins, however, maintain a substantially fixed position as the rocket flies (except in response to pressure) since the runners are not fixed to the nozzle body but each is free to rotate relative to the other. As a result of the flutes in the nozzle body, the missile body exits the launch tube with a finite rotational velocity, thereby minimizing the effects of thrust and mass asymmetries. At the tube exit condition, aerodynamic asymmetries are eliminated by decoupling the motion of the fins from the rotational motion of the missile body. Furthermore, due to the unique characteristics of wrap-around fins (non-zero rolling moment at zero angles of attack), decoupled wrap-around fins continue to spin at finite rotational speeds throughout the trajectory of the missile. Such spin is well-known to improve missile accuracy. It has been found that a rocket having the freely rotatable wrap-around fins may attain a dispersion of roughly 3.0 mils per 1000 ft. whereas a non-freely rotating rocket with wrap-around fins can attain a dispersion of roughly 13.0 mils per 1000 ft.

Obviously, many modifications and variations of the present invention are possible in light of the above teachings. It is therefore to be understood that, within the scope of the appended claims, the invention may be practiced otherwise than as specifically described.

What is claimed is:

1. Means for improving the ballistic accuracy of a rocket missile which has a nozzle at the aft end formed with a narrower mid-section than its end sections, the end sections which project above said mid-section being formed each with a circular slot therein, the slots facing each other, said system comprising, in combination:

a plurality of fin means for guiding and stabilizing the flight of said missile, said fin means being of the wrap-around type;

biasing means for erecting said fin means when said fin means are clear of a missile launcher tube;

freely rotating runner means for mounting said fin means on said missile, said runner means being a spool-like member fitting around said mid-section of said nozzle and being free to rotate relative to said missile, said fin means rotating with said runner means, and said spool-like member having a circular flange at each end, the outer end of each flange being formed with a circular neck ring; and a pair of circular bearings each of which fits securely into a different one of said circular slots in said end sections and each of which is formed with a corresponding circular slot therein, each said neck ring fitting into a different one of said circular slots in said bearings.

2. Means as in claim 1 wherein said biasing means comprises a coil spring.

3. Means as in claim 1 wherein:

said spool-like member has a flange at each end, each said flange being formed with retaining holes which face and pair with the retaining holes on the other flange, each said fin means is formed with tubular mounting means on the side of the fin means nearest the missile when erected, and each said fins means further includes a mounting rod which is inserted through said tubular mounting means and extends between said flanges fitting into a pair of retaining holes therein.

4. Means as in claim 1, wherein said circular bearings are made from a low-friction material and said system further comprises a coating of low-friction material between said spool-like member and the narrower section of said nozzle.

5. Means for improving the ballistic accuracy of a projected missile comprising in combination:

a plurality of wrap-around fin means for guiding and stabilizing the flight of a projected missile;

biasing means for erecting said fin means when said fin means are clear of a missile launcher tube;

freely rotating runner means for mounting said fin means on said missile, said runner means being free to rotate relative to said missile, said fin means rotating with said runner means; and means for causing the missile body to rotate, said means being a nozzle body in said missile through which the gases from a rocket propellant material exit, the interior of said nozzle body being formed with flutes and rotation of the missile body being caused by the reaction of exiting gases on said flutes.

6. Means as set forth in claim 5, wherein said runner means comprises a spool-like member.

7. Means as set forth in claim 6, wherein said spool-like member is formed with pairs of retaining holes and each of said fin means is formed with tubular mounting means on the side of the fin means nearest the missile when erected, each of said fin means further including a mounting rod, said rod being inserted through said tubular means and fitting into a pair of retaining holes on opposite sides of said spool-like member.

8. Means as set forth in claim 6, wherein said runner means fits around the outside of said missile, and further including a coating of low-friction material between the runner means and said missile.

9. Means for improving the ballistic accuracy of a rocket missile which has a nozzle at the aft end formed with a narrower mid-section than its end sections, the end sections which project above said mid-section being formed each with a circular slot therein, the slots facing each other, said system comprising, in combination:

a plurality of fin means for guiding and stabilizing the flight of said missile, said fin means being of the wrap-around type;

biasing means for erecting said fin means when they are clear of a missile launcher tube;

freely rotating runner means for mounting said fin means on said missile, said runner means being a spool-like member fitting around said mid-section of said nozzle around which said fin means wrap, said runner means being free to rotate relative to said missile, the fin means rotating with said runner means, and means for causing the missile body to rotate.

10. Means for improving the ballistic accuracy of a rocket missile which has a nozzle at the aft end formed with a narrower mid-section than its end sections, the end sections which project above said mid-section being formed each with a circular slot therein, the slots facing each other, said system comprising, in combination:

a plurality of fin means for guiding and stabilizing the flight of said missile, said fin means being of the wrap-around type;

biasing means for erecting said fin means when said fin means are clear of a missile launching tube;

freely rotating runner means for mounting said fin means on said missile, said runner means being free to rotate relative to said missile, said fin means rotating with said runner means; and means for causing the missile body to rotate, the interior of the nozzle formed with flutes and rotation of the missile body being caused by the reaction of exiting gases from the rocket propellant material on said flutes.

11. Means as in claim 10, wherein:

said spool-like member has a flange at each end, each said flange being formed with retaining holes which face and pair with the retaining holes on the other flange, each said fin means is formed with tubular mounting means on the side of the fin means nearest the missile when erected, and each said fins means further includes a mounting rod which is inserted through said tubular mounting means and extends between said flanges fitting into a pair of retaining holes therein.

12. Means as in claim 10, wherein said spool-like member has a circular flange at each end, the outer end of each flange being formed with a circular neck ring, said system further comprising a pair of circular bearings each of which fits securely into a different one of said circular slots in said end sections and each of which is formed with a corresponding circular slot therein, each said neck ring fitting into a different one of said circular slots in said bearings.

13. Means as in claim 12, wherein said circular bearings are made from a low-friction material and said system further comprises a coating of low-friction material between said spool-like member and the narrower section of said nozzle.

* * * * *